US008496101B2

(12) United States Patent
Cha et al.

(10) Patent No.: US 8,496,101 B2
(45) Date of Patent: Jul. 30, 2013

(54) MEDIUM RECOVERY DEVICE FOR MEDIUM PROCESSING DEVICE

(75) Inventors: Jin Hwan Cha, Seoul (KR); Dong Sik Lee, Seoul (KR); Hyun Soo Jang, Seoul (KR); Sung Jin Moon, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 121 days.

(21) Appl. No.: 13/130,713

(22) PCT Filed: Nov. 24, 2009

(86) PCT No.: PCT/KR2009/006911

§ 371 (c)(1),
(2), (4) Date: May 23, 2011

(87) PCT Pub. No.: WO2010/059010

PCT Pub. Date: May 27, 2010

(65) Prior Publication Data

US 2011/0226581 A1 Sep. 22, 2011

(30) Foreign Application Priority Data

Nov. 24, 2008 (KR) ..... 10-2008-0117044

(51) Int. Cl.
*G07D 11/00* (2006.01)

(52) U.S. Cl.
USPC ..... 194/350; 194/344

(58) Field of Classification Search
USPC ..... 194/206, 344, 350, 353; 271/182, 271/207, 278; 220/23.6, 504, 732; 193/32, 193/34, 40; 312/193, 350; 232/26, 44
See application file for complete search history.

(56) References Cited

U.S. PATENT DOCUMENTS

| | | | | |
|---|---|---|---|---|
| 2004/0016621 | A1* | 1/2004 | Jenrick et al. | 194/206 |
| 2004/0016798 | A1* | 1/2004 | Saltsov et al. | 235/379 |
| 2007/0000821 | A1* | 1/2007 | Nagura | 209/534 |

FOREIGN PATENT DOCUMENTS

| | | | |
|---|---|---|---|
| JP | 2003-051050 | A | 2/2003 |
| JP | 2003-263665 | A | 9/2003 |
| KR | 10-0185207 | B1 | 12/1998 |

OTHER PUBLICATIONS

PCT International Search Report and Written Opinion, PCT/KR2009/006911, Jul. 16, 2010, 11 Pages (with English translation).

* cited by examiner

*Primary Examiner* — Mark Beauchaine
(74) *Attorney, Agent, or Firm* — Fenwick & West LLP

(57) ABSTRACT

A medium recovery device for medium processing device may provide a barrier that is internally provided to be inclined, and may increase a storage amount of uncollected media stacked in the media retraction device.

9 Claims, 6 Drawing Sheets

MEDIUM RECOVERY DEVICE FOR MEDIUM PROCESSING DEVICE

TECHNICAL FIELD

The present invention relates to a media retraction device of a media transaction apparatus, and more particularly, to a media retraction device of a media transaction apparatus that may increase a storage capacity of a retraction portion configured to store uncollected media among media that is not processed as a deposit and is returned to the user among deposited media.

BACKGROUND ART

An automatic teller machine (ATM) or an unmanned automated device corresponds to an automated device that may provide basic financial services such as deposit and withdrawal in association with financial services, without a need of a banking teller and without a restriction on a time and an occasion.

The ATM may be generally classified into a cash withdrawing device and a cash depositing device according to deposit and withdrawal. Currently, the ATM is being used for various purposes such as depositing/withdrawing of a check, a bankbook arrangement, depositing of a gyro, and the like in addition to depositing/withdrawing of cash.

In the following detailed description, a note deposit apparatus will be described as an example but the present invention is not limited thereto. Specifically, the note deposit apparatus may be described as a media transaction apparatus that may receive various types of media such as checks, cash, various types of bills, and the like.

A conventional media transaction apparatus includes a deposit portion to receive media for depositing of a customer, a transfer path to transfer media deposited via the deposit portion, a determination portion being installed in the transfer path to determine whether media is abnormal, a temporary stack portion to temporarily store media passing through the determination portion, a plurality of cassette boxes in which the media deposited from the customer is stacked, and the like.

Also, the media transaction apparatus may further include a retraction portion to store media uncollected by the customer among the deposited media.

The retraction portion may include a first retraction space to store forged media among the deposited media and a second retraction space to store uncollected media among the deposited media. The first retraction space and the second retraction space may be separate from each other by means of a barrier.

Here, media deposited into the second retraction space may be received to be vertical with respect to a floor surface of the second retraction space. Accordingly, a relatively small amount of media may be received compared to an available storage capacity of the second retraction space. Accordingly, it is inconvenient to frequently replace the retraction portion for securing a retraction space of uncollected media.

DISCLOSURE OF INVENTION

Technical Goals

An aspect of the present invention provides a media retraction device of a media transaction apparatus having a retraction space capable of securing a receiving space of media to be stored in the media retraction device.

Another aspect of the present invention also provides a media retraction device of a media transaction apparatus that may increase a media storage capacity by about three times compared to an existing storage capacity by obliquely stacking media within a retraction space.

Technical Solutions

According to an aspect of the present invention, there is provided a media retraction device of a media transaction apparatus to retract abnormal media and uncollected media, the media retraction device including: a housing; and a barrier to separate an inside of the housing into a first retraction space for stacking forged media and a second retraction space for stacking the uncollected media. The barrier may include: a stacking surface contacting with a floor surface of the second retraction space, and being inclined to stack media; and a protruded support surface being connected to a one end of an upper portion of the stacking surface to prevent interference between media to be newly stacked and stacked media.

Here, the protruded support surface may be protruded towards the first retraction space. The protruded support surface may minimize interference between media to be newly received in the second retraction space and media obliquely stacked on the stacking surface and the protruded support surface. Specifically, while a top end of the stacked media is obliquely leaning against the protruded support surface, it is possible to minimize interference between media by minimizing a contact between the top end of the stacked media and a bottom end of the newly received media.

The media retraction device may further include a collision portion being formed with a collision surface facing the barrier, being downwardly inclined towards the barrier, and initially colliding with media when media to be stacked is injected into the barrier.

In particular, the collision portion may further include an extended surface being extended from the collision surface towards the floor surface of the second retraction space, and a stepped portion may be formed in a connection portion between the extended surface and the collision surface. The collision surface may be formed so that the connection portion and the protruded support surface may face each other.

The collision surface may change a transfer direction so that media obliquely injected towards the collision surface may collide with the collision portion and then be transferred towards the stacking surface. In addition, the stepped portion formed in the connection portion between the extended surface and the collision portion may increase the volume of the second retraction space, thereby increasing an amount of media to be stacked along the stacking surface.

An amount of media vertically stacked corresponds to about 50 pieces of media in the conventional art, whereas the media retraction device according to the aforementioned configuration of the present invention may obliquely stack about 150 pieces of media. Specifically, a storage amount may increase by about three times compared to the conventional art.

The connection portion between the extended surface and the collision surface may be formed to face the protruded support surface. Accordingly, media colliding with the collision surface may be smoothly stacked on the stacking surface without further colliding with the protruded support surface.

The extended surface may be formed to be spaced apart from a floor surface of the housing. Accordingly, even though a large amount of media is stacked on the stacking surface, it is possible to prevent an end of media from being rolled up.

It is possible to reduce a collision friction between media and the collision surface by forming a plurality of ribs on the collision portion.

Effect of the Invention

According to embodiments of the present invention, there may be provided a media retraction device that may further increase a receiving space. For example, by forming a curved surface capable of enlarging an inlet of a media storage space on a barrier disposed within a retraction space, it is possible to induce the effect as if a space for receiving uncollected media is enlarged.

Also, according to embodiments of the present invention, media to be stacked may be stacked in an oblique state and thus, it is possible to uniformly stack the media. As a result, an amount of media stacked may increase by about three times compared to an existing conventional art and thus, it is possible to store a relatively large amount of media.

Also, according to embodiments of the present invention, by enlarging an inlet of a first retraction space for receiving forged media, the forged media may be readily received in the first retraction space.

BEST MODE FOR CARRYING OUT THE INVENTION

Figure 1:
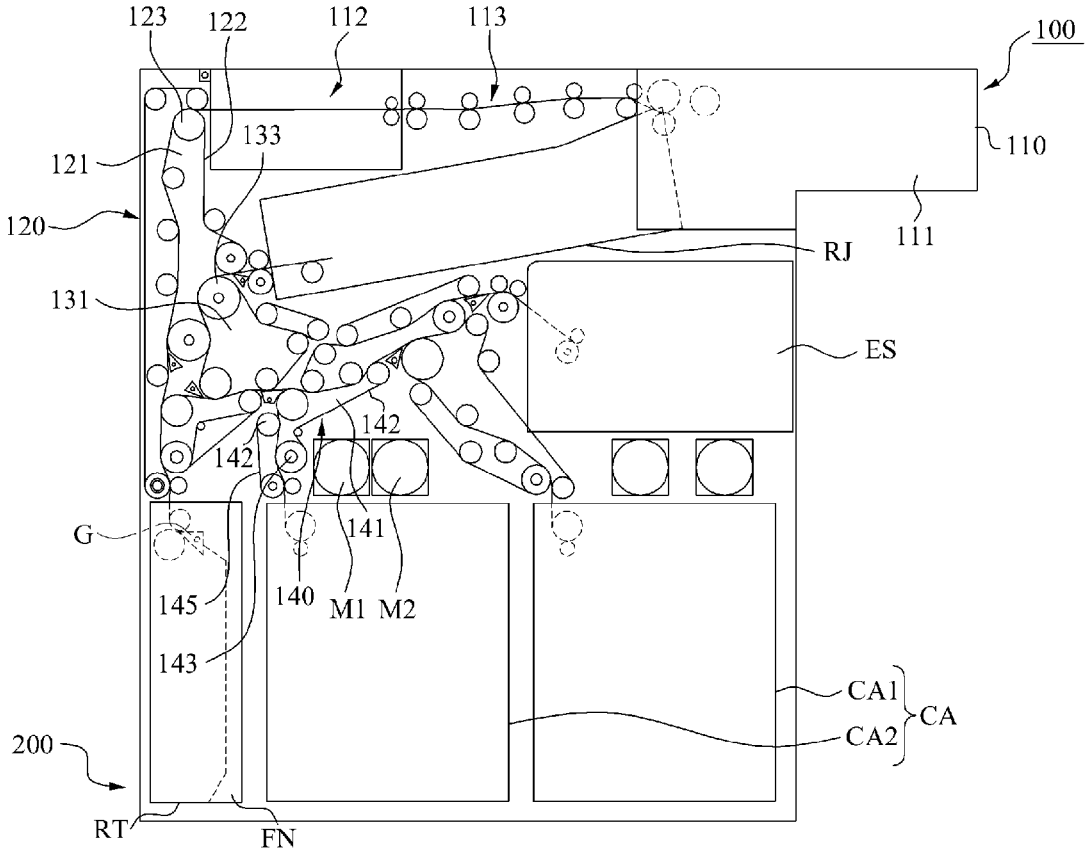
FIG. 1 is a cross-sectional view illustrating a media transaction apparatus according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

Hereinafter, a configuration of a media transaction apparatus and an operation thereof according to an embodiment of the present invention will be described in detail with reference to the accompanying drawings. The following description will be one of various aspects and may constitute a portion of the detailed description regarding the present invention. In describing the present invention, detailed description related to a known function or configuration will be omitted to make the purpose of the present invention clear.

Hereinafter, a media transaction apparatus for depositing paper media such as notes, checks, and the like according to an embodiment of the present invention will be described. However, the media transaction apparatus is only an example of an automatic teller machine (ATM) and thus, may also be applicable to other types of ATMs such as a media depositing/withdrawing apparatus, and the like.

Figure 2:
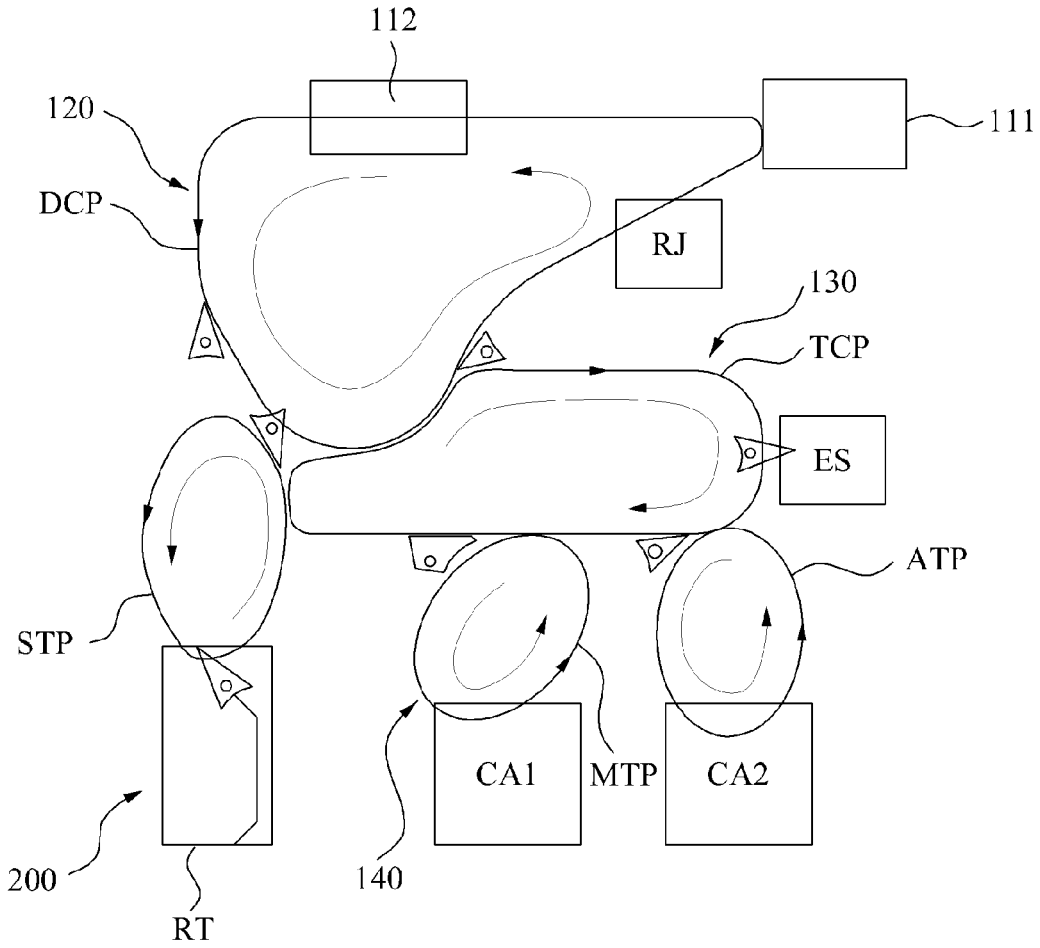
FIG. 2 is a cross-sectional view to describe a circulation direction of paths used in the media transaction apparatus of FIG. 1.

FIG. 1 is a cross-sectional view illustrating a media transaction apparatus 100 according to an embodiment of the present invention, and FIG. 2 is a cross-sectional view to describe a circulation direction of paths used in the media transaction apparatus 100 of FIG. 1.

As shown in FIG. 1 and FIG. 2, the media transaction apparatus 100 includes a housing 110 that forms an external shape and internally includes various types of parts. A media deposit device 111 is provided in one side of the housing 110 so that a customer may deposit media such as cash, checks, and the like.

Also, the housing 110 includes a plurality of belts and a plurality of rollers to form a plurality of paths for transferring the deposited media. The plurality of paths may include a deposit circulation path DCP, a temporary circulation path TCP, and a media transfer path MTP. Here, the deposit circulation path DCP may connect the media deposit device 111 and a reject device, for example, a reject box RJ (hereinafter, reject device RJ) for rejecting abnormal media among the deposited media. The temporary circulation path TCP may connect the deposit circulation path DCP and a temporary stack device, for example, an escrow box ES (hereinafter, temporary stack device ES), for temporarily storing normal media among the deposited media. The media transfer path MTP may connect the temporary circulation path TCP and a media storage device, for example, a cassette box CA (hereinafter, media storage device CA) for receiving the temporarily stored media.

Here, a media retraction device, for example, a retract box (hereinafter, media retraction device RT) for retracting uncollected media or storing forged media among predetermined abnormal media may be further included.

More specifically, media injected into the media deposit device 111 may pass through a deposit path 113 that is formed on an outlet side of the media deposit device 111. Here, a plurality of rollers (not shown) may be provided in the outlet side of the media deposit device 111 to send the deposited media to the deposit path 113.

The deposit path 113 may include two belts that are disposed to face each other, and rollers to drive the belts. Also, the deposit path 113 may include a single belt and a guide (not shown) to face the single belt.

The media may be transferred to a media recognition portion 112 along the deposit path 113. The media recognition portion 112 may determine whether the deposited media is normal or forged using a variety of sensors, an image scanner, and the like. For example, the media recognition portion 112 may determine abnormal media such as double-sheet media, folded media, and the like among the deposited media. Also, the media recognition portion 112 may determine whether the deposited media is forged.

To transfer the abnormal media to the reject device RJ and thereby reject the abnormal media without processing the deposited media as a deposit in a case where the deposited media is abnormal media as a determination result at the media recognition portion 112, for example, in a case where the deposited media is partially torn or folded, the deposit circulation path DCP may be provided on an outlet side of the media recognition portion 112 and the reject device RJ may be mounted on one side of the deposit circulation path DCP.

The media determined as normal media at the media recognition portion 112 may not pass through the rejection device RJ and be transferred to the temporary stack device ES. The temporary circulation path TCP may be formed between the deposit circulation path DCP and the temporary stack device ES in order to transfer the media to the temporary stack portion ES.

The media temporarily stored in the temporary stack portion ES may be transferred to the media storage device CA to complete a depositing transaction of media. The media transfer path MTP may be formed between the temporary stack device ES and the media storage device CA to transfer the media to the media storage device CA. Specifically, a portion of the media transfer path MTP may contact with the temporary circulation path TCP to thereby share a portion thereof. Another portion of the media transfer path MTP may be connected to the media storage device CA.

Also, a specific transfer path SIP may be formed to retract the abnormal media among paths for transferring, to a media retraction device 200, media that is determined as abnormal media at the media recognition portion 112 or of which transaction is cancelled and thereby that is returned to a user and is uncollected by the user. A retraction path may be formed to separately collect media for which the customer has not taken any action such as a cancellation or a collection, among the media temporarily stored in the temporary stack device ES.

Here, the media retraction device 200 may be separated into a first retraction space for retracting the abnormal media such as forged media and the like, and a second retraction space for storing media uncollected by the user. The first retraction space and the second retraction space may be integrally formed and thereby be provided in the retraction transfer path. The first retraction space and the second retraction space will be further described later.

A plurality of media storage devices CAs may be disposed since an amount of normally processed media is greater than an amount of uncollected media or forged media. FIG. 1 illustrates two media storage devices CAs. In this case, the two media storage devices CAs may be configured as a first media storage device CA connected to the media transfer path MTP and as a second media storage device CA disposed on one side of the media storage device CA.

When an additional media storage device is provided, an additional transferring path ATP may be further provided to transfer media to the second media storage device CA. The additional transfer path ATP may contact with the temporary circulation path TCP and thereby share a portion thereof and be connected to the second media storage device CA.

Figure 3:
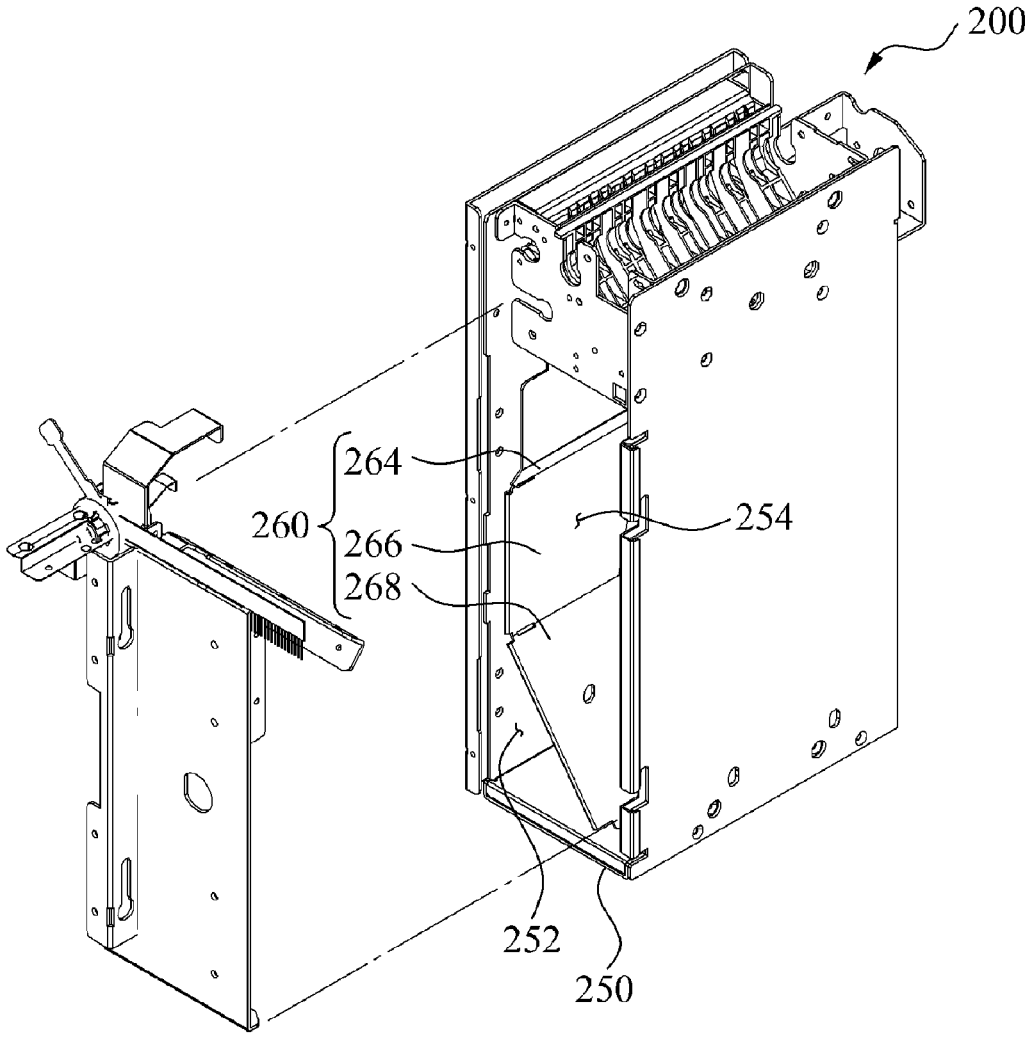
FIG. 3 is a perspective view illustrating a media retraction device of the media transaction apparatus of FIG. 1.
Figure 4:
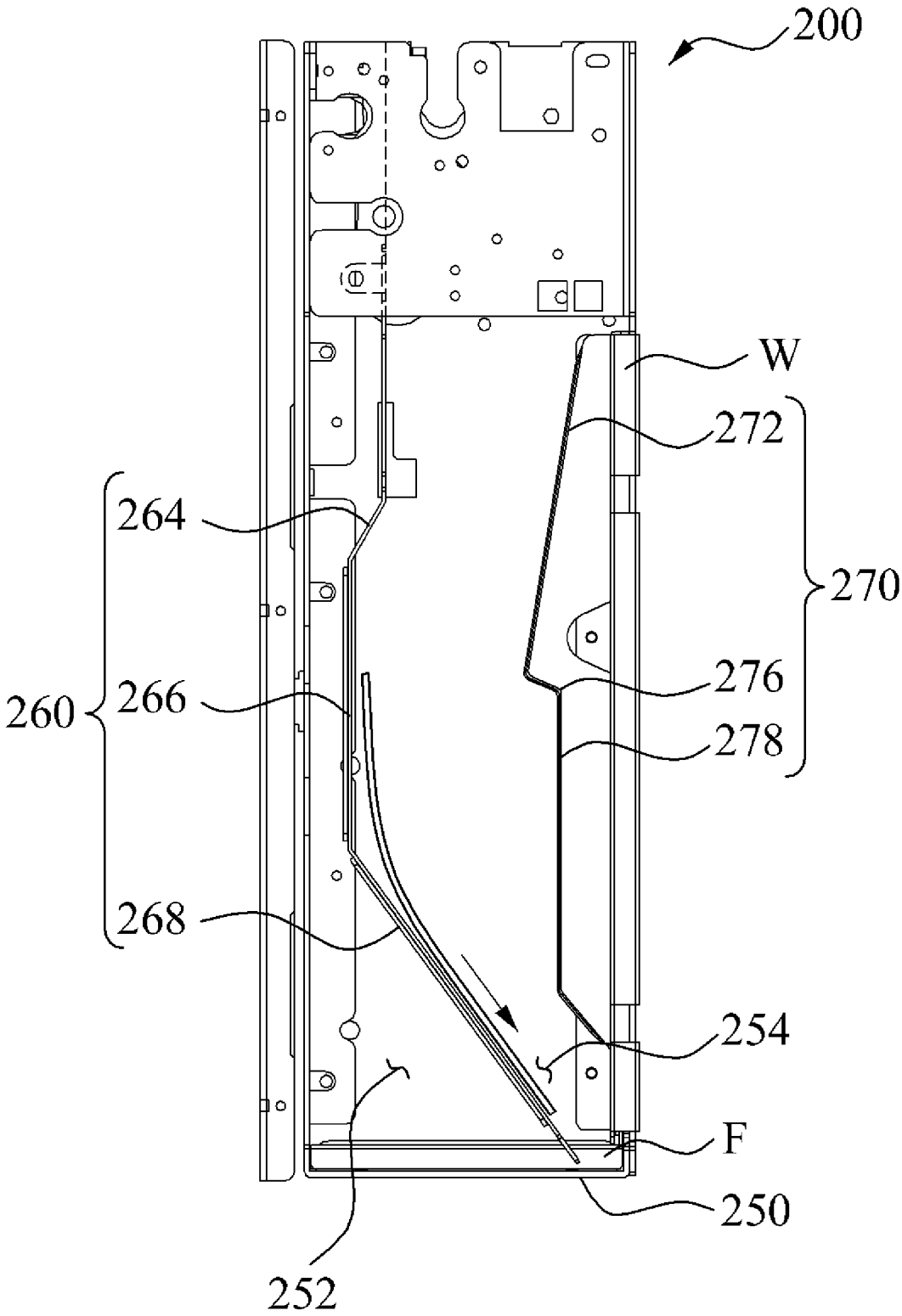
FIG. 4 is a cross-sectional view illustrating the media retraction device of FIG. 3.
Figure 5:
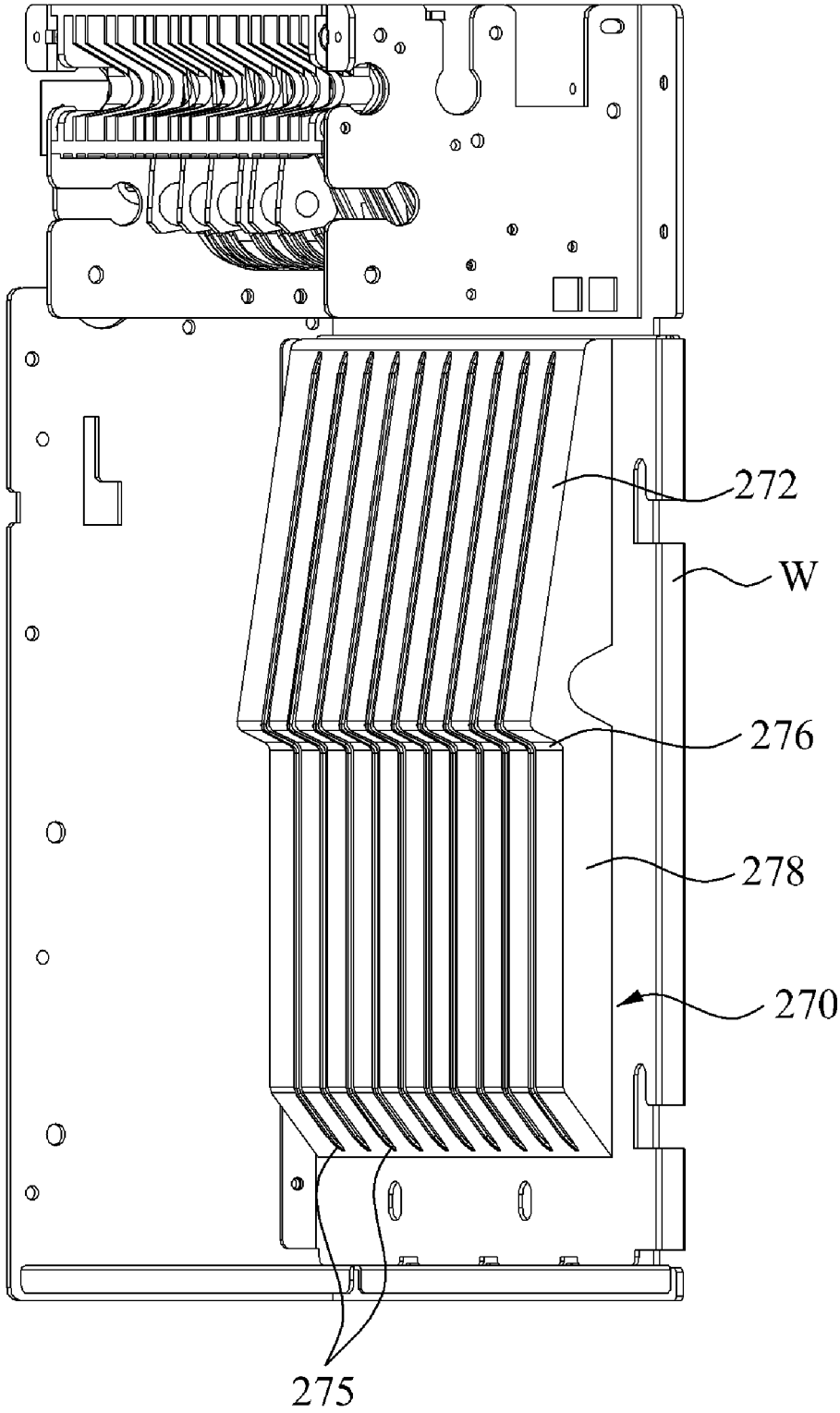
FIG. 5 is a cross-sectional view illustrating a collision portion disposed in the media retraction device.

FIG. 3 is a perspective view illustrating the media retraction device 200 FIG. 1, FIG. 4 is a cross-sectional view illustrating the media retraction device 200 of FIG. 3, and FIG. 5 is a cross-sectional view illustrating a collision portion 270 disposed in the media retraction device 200.

Referring to FIG. 3, the media retraction device 200 may include a housing 250, and a barrier 260 separating an inside of the housing 250 into a first retraction space 252 and a second retraction space 254. The barrier 260 may be provided within the media retraction device 200 to separately store abnormal media such as forged media, torn media, and the like, and media uncollected by a customer among media recognized at the media recognition portion 112. In this instance, the forged media may be stored in the first retraction space 252 and the uncollected media may be stored in the second retraction space 254.

The barrier 260 may include a curved surface 264, a protruded support surface 266, and a stacking surface 268. The barrier 260 may be positioned so that a volume of the second retraction space 254 may be greater than a volume of the first retraction space 252.

Here, the curved surface 264 may be inclined towards the first retraction space 252 and function to enlarge an inlet of the first retraction space 252 so that forged media may be smoothly received in the first retraction space 252. That is, since the volume of the second retraction space 254 is greater than the volume of the first retraction space 252, forged media being transferred to the first retraction space 252 may not be properly received in the first retraction space 252. Accordingly, by enlarging the inlet via which the forged media is transferred, the forged media may be readily received in the first retraction space 252. Since a space for storing the forged media is enlarged, it is possible to prevent the forged media from being received in the second retraction space 254.

Accordingly, when the curved surface 264 is inclined towards the first retraction space 252, the inlet of the first retraction space 252 may be larger than the space for stacking the forged media and thus, the forged media may smoothly pass.

The protruded support surface 266 may be vertically connected to another end of a lower portion of the curved surface 264. Specifically, the protruded support surface 266 may be protruded towards the first retraction space 252. The protruded support surface 266 may prevent intervention between stacked media and media to be newly stacked. Specifically, media deposited into the second retraction space 254 may be obliquely stacked along the protruded support surface 266 and the stacking surface 268. When newly media is deposited into the second retraction space 254, an end of existing stacked media and an end of new media being deposited may collide with each other, the media being transferred may not be stacked at a proper position and may also block an inlet of the second retraction space 254.

Accordingly, to prevent the stacked media from blocking the direction into which the new media is to be stacked, the protruded support surface 266 may be provided to be protruded towards the first retraction space 252. Therefore, since the existing media is stacked leaning against the protruded support surface 266, it is possible to prevent the newly stacked media from colliding with the existing stacked media.

The stacking surface 268 may be provided at the lower end of the protruded support surface 266 to be inclined towards the second retraction space 254, and to stack media in an oblique state together with the protruded support surface 266.

The stacking surface 266 may perform a functionality as a main surface on which deposited media may be substantially stacked. An angle of inclination of the stacking surface 268 may vary based on a storage amount of media to be stacked, a requirement of the invention, and the like. However, it is only an example and thus, the present invention is not limited or restricted by the angle of inclination of the stacking surface 268.

Referring to FIG. 4 and FIG. 5, the collision portion 270 may be formed on an inner wall of the second retraction space 254 to face the barrier 260. The collision portion 270 may include a collision surface 272 and an extended surface 278.

The collision surface 272 may be a surface with which media deposited into the second retraction space 254 may initially collide. The collision surface 272 may change a direction of media being deposited to thereby enable the media to be obliquely stacked on the stacking surface 268. Specifically, the collision surface 272 may be formed to be inclined towards a middle portion of the barrier 260 or the second retraction space 254 and thereby provide a reaction for enabling the media colliding with the collision portion 270 to be towards the barrier 260.

The collision portion 270 may include the extended surface 278 extended from the collision surface 272 towards a floor surface F of the second retraction space 254. In particular, a stepped portion 276 may be formed in a connection portion between the collision surface 272 and the extended surface 278. The stepped portion 276 may be bent towards an inner wall W of the second retraction space 254. The stepped portion 276 may provide a maximum reaction capable of changing a movement direction of media transferred into a diagonal direction towards the collision portion 270 to be towards the barrier 260. By enlarging a space between the barrier 260 and the extended surface 278, it is possible to enhance a storage amount of media stacked in the second retraction space 254.

In particular, the connection portion may be formed in a section facing the protruded support surface 266. An upper portion of media to be stacked in the second retraction space 252 may be finally guided to such connection portion.

In the case of uncollected media to be stacked in the second retraction space 254, about 50 pieces of uncollected media may be stacked in an existing vertical stacking method, whereas about 150 pieces of uncollected media may be stacked by means of the obliquely formed barrier 260. Accordingly, it is possible to enhance a storage amount by three times.

A plurality of ribs 275 may be formed in the collision portion 270. Since media to be deposited into the second retraction space 254 is deposited in a lengthwise direction, the media may be unevenly arranged and thereby stacked. Accordingly, compared to a stackable amount in the second retraction space 254, a relatively small amount of media may be stacked in the second retraction space 254. In this instance, by forming the plurality of ribs 275, it is possible to uniformly arrange media deposited into the second retraction space 254. Specifically, the plurality of ribs 275 may function to secure a spare space of media being subsequently deposited by appropriately arranging media that is deposited without being arranged. The plurality of ribs 275 may be provided to be spaced apart from each other at predetermined intervals. The plurality of ribs 275 may function to reduce friction between media to be stacked and the collision portion 270.

In the meantime, the housing 250 may include a gate G (see FIG. 1) to guide media according to a type of media to be injected into the first retraction space 252 or the second retraction space 254. Based on the type of media injected into the housing 250, the gate G may be mounted to the first retraction space 252 or the second retraction space 254. For example, when media to be retracted is injected into the housing 250, the gate G may be mounted to the first retraction space 252. When forged media is injected into the housing 250, the gate G may be mounted to the second retraction 254, thereby forming an inlet via which the media is to be injected. In particular, when the gate G is mounted to the first retraction space 252, media being injected into the second retraction space 254 may be diagonally injected towards the collision portion 270 and thereby collide with the collision portion 270.

Figure 6:
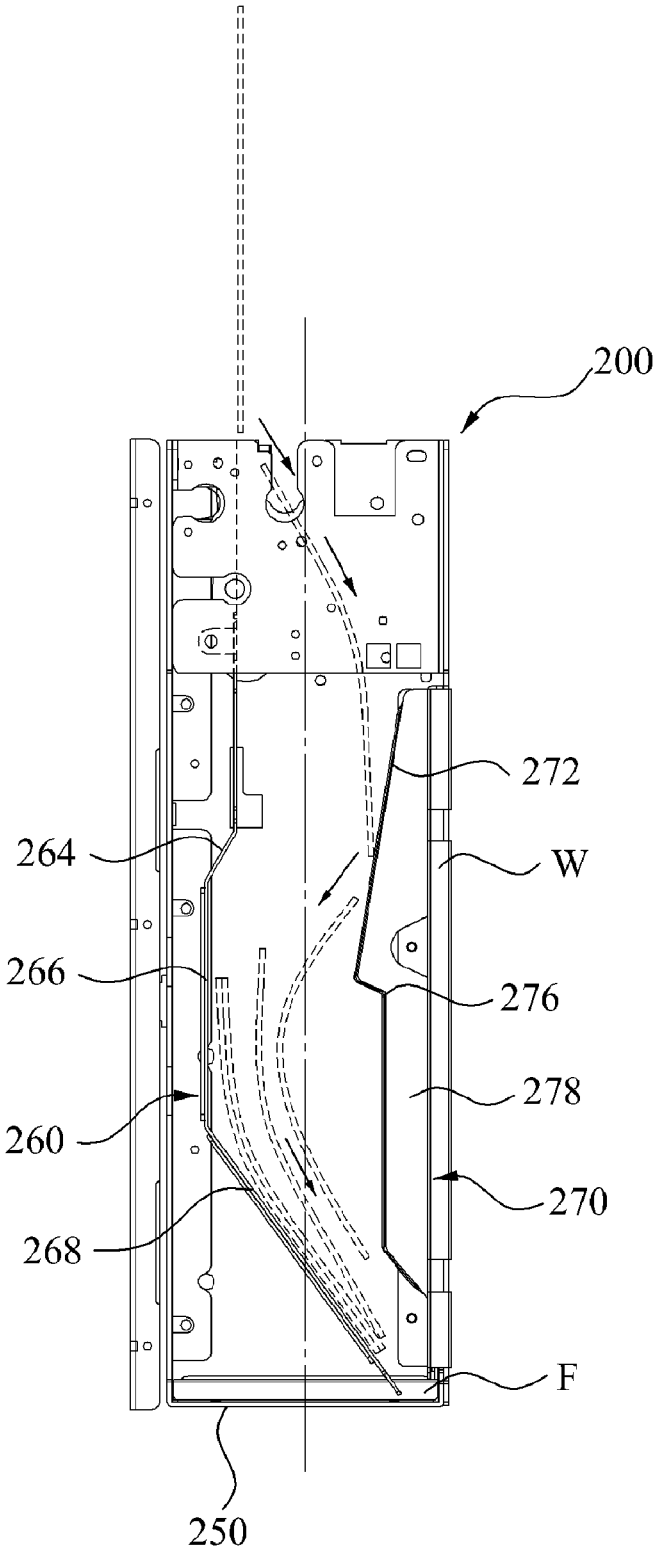
FIG. 6 is a cross-sectional view to describe a process of receiving media in a second retraction space.

FIG. 6 is a cross-sectional view to describe a process of receiving media in the second retraction space 254.

Referring to FIG. 6, media uncollected by a user or a customer may be deposited into the second retraction space 254. In this instance, the media may be initially injected into a diagonal direction towards the collision portion 270.

Media deposited into the second retraction space 254 may most initially collide with the collision surface 272 of the collision portion 270. Media flowing along the collision surface 272 may change a movement direction towards the barrier 260 at a position close to the stepped portion 276.

The media of which the movement direction is changed may be obliquely stacked along the protruded support surface 266 and the stacking surface 268 of the barrier 260.

According to the above configuration, the media may collide with the collision portion 270 and be obliquely stacked along the protruded support surface 266 and the stacking surface 268. Compared to the conventional art in which media is vertically stacked, an amount of media stacked by the collision portion 270 may increase by about three times or more. Specifically, while about 50 pieces of uncollected media may be stacked in the existing vertical stacking method, about 150 pieces of uncollected media may be stacked using the obliquely formed barrier 260. Accordingly, since there is no need to frequently replace the media retraction device 200, it is possible to enhance the work efficiency of an operator.

Even though a media retraction device is described above in aspects of an ATM for deposit, the media retraction device may be applicable for an ATM for deposit and withdrawal, and the like. Accordingly, the aforementioned media retraction device may be understood as technical spirits comprehensible in various aspects or as minimum technology for the present invention and may not be understood as a boundary for limiting the present invention.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

The invention claimed is:

1. A media retraction device comprising:

a housing comprising:

a collision portion having a collision surface facing an interior of the housing and slanted downward towards a bottom of the housing, the collision surface placed to initially come into contact with and bounce an uncollected medium inserted into the housing, an extended surface extending downward towards the floor surface of the housing, and a stepped connection portion between the extended surface and the collision surface, and a barrier placed within the housing and configured to separate an interior of the housing into first retraction space for stacking forged media and second retraction space for stacking uncollected media, wherein the barrier comprises:

a stacking surface in contact with the bottom of the housing, the stacking surface slanted to stack the uncollected media in a slanted manner, and a protruded support surface extending upward from an upper end portion of the stacking surface, the protruded support surface configured to prevent interference between the uncollected medium dropping after bouncing from the collision surface and uncollected media previously stacked on the stacking surface.

2. The media retraction device of claim 1, wherein the stepped connection portion is formed to face the protruded support surface.

3. The media retraction device of claim 2, wherein a lower end of the extended surface is spaced apart from the floor of the housing by a predetermined distance.

4. The media retraction device of claim 1, wherein the uncollected media are piled in a direction towards the collision surface.

5. The media retraction device of claim 1, wherein a plurality of ribs is formed on the collision portion.

6. A media retraction device comprising:

a housing comprising:

a collision portion having a collision surface facing an interior of the housing and slanted downward towards a bottom of the housing, the collision surface placed to initially come into contact with and bounce an uncollected medium inserted into the housing, and a barrier placed within the housing and configured to separate an interior of the housing into first retraction space for stacking forged media and second retraction space for stacking uncollected media, wherein the barrier comprises:

a stacking surface in contact with the bottom of the housing, the stacking surface slanted to stack the uncollected media in a slanted manner, a protruded support surface extending upward from an upper end portion of the stacking surface, the protruded support surface configured to prevent interference between the uncollected medium dropping after bouncing from the collision surface and uncollected media previously stacked on the stacking surface, and a curved surface connected to an upper end of the protruded support surface and formed with a portion stepped with respect to the protruded support surface to enlarge an inlet of the first retraction space.

7. The media retraction device of claim 6, wherein the curved surface is slanted towards the first retraction space, the stacking surface is slanted towards the collision portion, and the protruded support surface is protruded towards the first retraction space.

8. The media retraction device of claim 6, wherein the uncollected medium inserted into the second retraction space drops in a diagonal direction towards the collision portion, and the uncollected media is stacked to come in contact with the bottom of the housing.

9. The media retraction device of claim 6, wherein a plurality of ribs is formed on the collision portion.

* * * * *